US009236664B2

(12) United States Patent
Hayakawa et al.

(10) Patent No.: US 9,236,664 B2
(45) Date of Patent: Jan. 12, 2016

(54) ANTENNA

(75) Inventors: Eisuke Hayakawa, Kobe (JP); Takeshi Okunaga, Sanda (JP); Takaaki Fujita, Sanda (JP)

(73) Assignees: FUJITSU TEN LIMITED, Kobe (JP); NIPPON PILLAR PACKING CO., LTD., Osaka (JP)

( * ) Notice: Subject to any disclaimer, the term of this patent is extended or adjusted under 35 U.S.C. 154(b) by 187 days.

(21) Appl. No.: 13/275,890

(22) Filed: Oct. 18, 2011

(65) Prior Publication Data

US 2012/0112976 A1 May 10, 2012

(30) Foreign Application Priority Data

Nov. 10, 2010 (JP) ..... 2010-251929

(51) Int. Cl.
*H01Q 13/10* (2006.01)
*H01Q 21/06* (2006.01)
*H01Q 9/04* (2006.01)

(52) U.S. Cl.
CPC ..... *H01Q 21/064* (2013.01); *H01Q 9/045* (2013.01); *H01Q 21/065* (2013.01)

(58) Field of Classification Search
USPC ..... 343/767, 700 MS
See application file for complete search history.

(56) References Cited

U.S. PATENT DOCUMENTS 3,757,343 A * 9/1973 Bogner ..... H01Q 11/04 343/770
4,063,245 A * 12/1977 James ..... H01Q 1/38 343/700 MS
4,291,311 A * 9/1981 Kaloi ..... H01Q 1/48 343/700 MS
4,899,163 A * 2/1990 Daniel ..... G01S 13/60 343/700 MS
5,977,924 A * 11/1999 Takei ..... H01Q 21/068 343/700 MS
6,424,298 B1 * 7/2002 Nishikawa ..... H01Q 21/0037 343/700 MS
2010/0026584 A1 * 2/2010 Nakabayashi ..... H01Q 21/065 343/700 MS

FOREIGN PATENT DOCUMENTS

| | | |
|---|---|---|
| JP | A-7-86826 | 3/1995 |
| JP | A-2000-312112 | 11/2000 |
| JP | A-2001-044752 | 2/2001 |
| JP | A-2001-111337 | 4/2001 |
| JP | A-2002-314325 | 10/2002 |

OTHER PUBLICATIONS

Robert A. Sainati, 'CAD of Microstrip Antennas for Wireless Applications, 1996, Artech House, pp. 50-62.*
Notice of Reasons for Rejection dated Jun. 24, 2014 from Japanese Patent Application No. 2010251929 (with English-language translation).

* cited by examiner

*Primary Examiner* — Hoang V Nguyen
*Assistant Examiner* — Hai Tran
(74) *Attorney, Agent, or Firm* — Oliff PLC

(57) ABSTRACT

An antenna which reduces the number of end faces and perpendicular corners, and suffers from little deterioration of performance even if used for high frequency transmission/reception, in particular a microstrip patch antenna which is comprised of a dielectric substrate on the bottom surface of which a conductive ground plate is formed and on the top surface of which a patch antenna part formed by a conductor and a feeder circuit connected to the same are provided, wherein the feeder circuit is connected to the antenna part while offset by exactly a predetermined distance to either end side from a center of one side of said antennas part to which said feeder circuit is to be connected so that a transmission loss of the antenna becomes a predetermined value or less. The predetermined distance can be made 20 to 70% of the longitudinal side of the patch antenna part.

2 Claims, 9 Drawing Sheets

(n is INTEGER)

(n is INTEGER)

(n is INTEGER)

(n is INTEGER)

| S | RESISTANCE | RESISTANCE OF LINE 60 REFLECTION COEFFICIENT | TRANSMISSION POWER [%] | TRANSMISSION LOSS [dB] |
|---|---|---|---|---|
| -1.00 | 3106.034 | 0.962098 | 7.4 | 11.3 |
| -0.78 | 263.4443 | 0.628993 | 60.4 | 2.2 |
| -0.63 | 56.0958 | -0.03363 | 99.9 | 0.0 |
| -0.48 | 47.82212 | -0.11294 | 98.7 | 0.1 |
| -0.33 | 142.2237 | 0.406598 | 83.5 | 0.8 |
| -0.19 | 157.4804 | 0.448226 | 79.9 | 1.0 |
| -0.04 | 1131.494 | 0.899286 | 19.1 | 7.2 |
| 0.04 | 1131.494 | 0.899286 | 19.1 | 7.2 |
| 0.19 | 157.4804 | 0.448226 | 79.9 | 1.0 |
| 0.33 | 142.2237 | 0.406598 | 83.5 | 0.8 |
| 0.48 | 47.82212 | -0.11294 | 98.7 | 0.1 |
| 0.63 | 56.0958 | -0.03363 | 99.9 | 0.0 |
| 0.78 | 263.4443 | 0.628993 | 60.4 | 2.2 |
| 1.00 | 3106.034 | 0.962098 | 7.4 | 11.3 |

ANTENNA

CROSS-REFERENCE TO RELATED APPLICATION

This application claims priority from, and incorporates by reference the entire disclosure of, Japanese Patent Application No. 2010-251929, filed on Nov. 10, 2010.

BACKGROUND OF THE INVENTION

1. Field of the Invention

The present invention relates to an antenna, more particularly relates to an antenna wherein an antenna part to which a feeder circuit is connected is simple in configuration and which can be used for an antenna for transmission and reception of waves from radar.

2. Description of the Related Art

In the past, as one art for improving the driving safety of automobiles and other vehicles, there has been on-board radar used for prevention of collisions and for adaptive cruise control. On-board radar transmits waves in the front direction from a vehicle and receive waves reflected at a target object (physical markers) positioned in the front direction from the vehicle so as to estimate the distance and angle between the vehicle and physical markers. In such radar, a microstrip patch antenna or slot antenna is used for transmission/reception of waves.

A general microstrip antenna is provided with a dielectric substrate, a patch antenna part which is formed on the dielectric substrate by etching, and a ground plate which is formed on the bottom surface of the dielectric substrate. The patch antenna part and the ground plate are formed by copper foil. The ground plate is also called a "grounding plate" or "earthing plate". Further, the patch antenna part has a feeder circuit connected to it.

A microstrip patch antenna provided with a patch antenna part and a feeder circuit connected to it is formed with slits in the patch antenna part for impedance matching. A feeder line matched to an input impedance of 50Ω is connected to the patch antenna part. The length of the patch antenna part in the polarization direction is a whole multiple of the length of about half of the wavelength by which the operating frequency of the wave transmitted or received is propagated (hereinafter referred to as the "guide wavelength").

Further, in another conventional example of a microstrip patch antenna provided with a patch antenna part and a feeder circuit connected to it, an impedance transformer is formed at the feeder circuit for enabling connection to the patch antenna part at a high impedance end. The feeder circuit which is connected to the impedance transformer makes the input impedance match 50Ω. The length of the patch antenna part in the polarization direction is a length of a whole multiple of about half of the guide wavelength, while the length of the impedance transformer is a whole multiple of one-quarter the length of the guide wavelength.

On the other hand, as the transmission/reception antenna of on-board radar, use of a flat array antenna using microstrip conductors is disclosed in Japanese Patent No. 3306592. Further, a slot array antenna comprised of a ground plate in which slot lines are provided and at the two sides of the slot lines of which slot devices are formed is disclosed in Japanese Patent Publication (A) No. 2001-111337. The flat array antenna disclosed in Japanese Patent No. 3306592 transmits and receives polarized waves in a direction inclined from the microstrip line. Japanese Patent No. 3306592, FIG. 7(*b*), discloses an example in which the terminal end of the feeder strip line is made to effectively radiate power by providing a microstrip antenna device provided with a patch antenna path formed with slits. Similarly, the slot array antenna disclosed in Japanese Patent Publication (A) No. 2001-111337 transmits and receives polarized waves in a direction inclined from the slot line. Japanese Patent Publication (A) No. 2001-111337, FIG. 7(*b*), discloses an example of provision of a slot element for effectively radiating power from the terminal end of the slot line.

However, if providing slits in the patch antenna part for impedance matching between the patch antenna part and the feeder circuit, the antenna shape becomes complicated and etching of the patch antenna part becomes difficult. Further, if connecting an impedance transformer of a high impedance to the patch antenna part, the width of the line of the impedance transformer becomes extremely fine. The line width ends up becoming narrower than the minimum line width of the processing limit. Processing therefore cannot be guaranteed.

Further, when using a microstrip patch antenna for high frequency transmission/reception, the wavelength of the operating frequency is short, so a small dimensional error will have a large effect on performance. That is, a conventional structure of a microstrip patch antenna has a large number of end faces and a complicated structure, so there was the problem of a large deterioration in performance due to manufacturing error at the time of pattern formation by etching etc. Further, in the slot array antenna disclosed in Japanese Patent Publication (A) No. 2001-111337 as well, there is a similar problem as with microstrip patch antenna of deterioration of the performance due to manufacturing error at the time of processing to form the slot patterns of the slot antenna. Further, as disclosed in Japanese Patent Publication (A) No. 2001-111337, FIG. 7(*b*), when connecting a corner of a slot element to the terminal end of a slot line, there was the problem that the residual power reaching the terminal end was not effectively radiated. Note that the above Japanese Patent No. 3306592 (Japanese Patent Application No. 2000-54606) and Japanese Patent Publication (A) No. 2001-111337 (Japanese Patent Application No. 11-141170) were combined for filing in the U.S. and have been granted as U.S. Pat. No. 6,424,298B1.

SUMMARY OF THE INVENTION

An object of the present invention is to eliminate the problems in the conventional microstrip patch antenna and slot antenna, reduce the number of end faces of the patch antenna part or slot antenna part, reduce the number of perpendicular corners, and thereby streamline the structure of the antenna part so as to reduce dimensional error and to thereby provide a microstrip patch antenna and slot antenna with little deterioration in performance even when using the antenna for high frequency transmission/reception. Further, another object is to provide an antenna which enables effective radiation of residual power when connecting an antenna part of a microstrip patch antenna or slot antenna to a terminal end of an array antenna.

To achieve this object, an antenna of the present invention is a microstrip patch antenna which is comprised of a dielectric substrate on the bottom surface of which a conductive ground plate is formed and on the top surface of which a rectangular shaped antenna part formed by a conductor and a feeder circuit formed by a conductor connected to the same are provided and is a slot antenna provided with an antenna part which is formed by a rectangular slot in a ground plate formed by a conductor and with a feeder circuit comprised of a slit connected to the same, wherein the feeder circuit is connected to the antenna part while offset by exactly a predetermined distance to either end side from a center of one side of said antennas part to which the feeder circuit is to be connected so that a transmission loss of the antenna becomes a predetermined value or less.

According to the antennas of the present invention, by just making the antenna part a rectangular shape and connecting the feeder circuit to the antennas part offset by exactly a predetermined distance to either end side from the center of one side of the antennas part to which the feeder circuit is to be connected, it is possible to reduce the number of end faces of antenna part and reduce the number of perpendicular corners to streamline the structure of the antenna part and reduce dimensional error at the time of antenna manufacture.

Further, due to this configuration, there is little deterioration in performance even when using the microstrip patch antenna and slot antenna for high frequency transmission/reception. Furthermore, if connecting the antenna of the present invention to the terminal end of an array antenna where radiation antenna elements are connected at equal intervals to the two sides of a feeder circuit, it is possible to effectively radiate from the antenna part the residual power which has been fed from the input end of the feeder circuit, travels through the feeder circuit, and reaches from the terminal end.

BRIEF DESCRIPTION OF THE DRAWINGS

The present invention is illustrated by way of example, and not limitation, in the figures of the accompanying drawings in which like references indicate similar elements. Note that the following figures are not necessarily drawn to scale.

DESCRIPTION OF THE PREFERRED EMBODIMENTS

Before describing the preferred embodiments, an explanation will be given of the conventional microstrip patch antenna shown in FIGS. 1A to 1C.

Figure 1A:
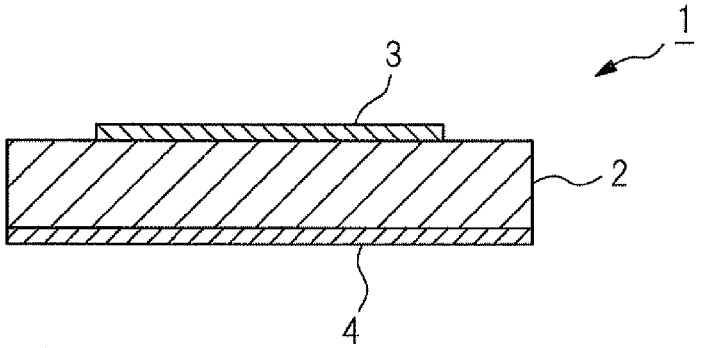
FIG.1A PRIOR ART
FIG. 1A is a cross-sectional view showing the general configuration of a conventional microstrip patch antenna.

FIG. 1A shows the configuration of a general microstrip antenna 1. The microstrip antenna 1 is provided with a dielectric substrate 2, a patch antenna part 3 which is formed on the dielectric substrate 2 by etching, and a ground plate 4 which is formed on the bottom surface of the dielectric substrate 2. The patch antenna part 3 and the ground plate 4 are formed by copper foil. The ground plate is also called a "grounding plate" or "earthing plate". Further, the patch antenna part 3 has a feeder circuit connected to it.

Figure 1B:
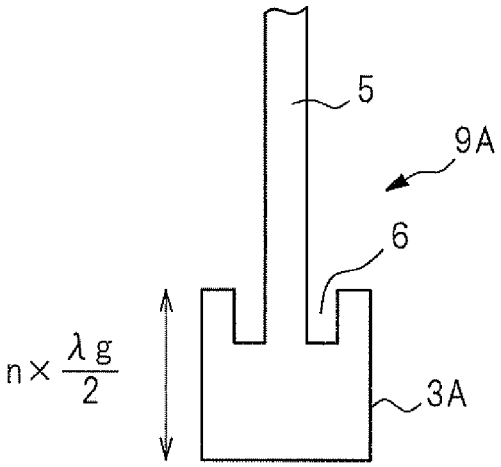
FIG.1B PRIOR ART
FIG. 1B is a plan view showing the shape of one example of a conventional microstrip patch antenna.

FIG. 1B shows a conventional example of a microstrip patch antenna 9A which is provided with a patch antenna part 3A and a feeder circuit 5 connected to the same. This example of a microstrip patch antenna 9A is formed with slits 6 for impedance matching at the patch antenna part 3A. A feeder line 5 with an input impedance matched to 50Ω is connected to the patch antenna part 3A. The length of the patch antenna part 3A in the polarization direction is a whole multiple of the length of about half of the wavelength λg by which the operating frequency of the wave being transmitted or received is propagated (hereinafter referred to as the "guide wavelength").

Figure 1C:
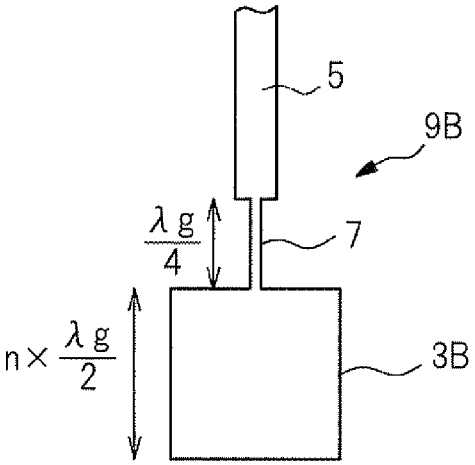
FIG.1C PRIOR ART
FIG. 1C is a plan view showing the shape of another example of a conventional microstrip patch antenna.

FIG. 1C shows another conventional example of a microstrip patch antenna 9B which is provided with a patch antenna part 3B and a feeder circuit 5 connected to the same. In this example of a microstrip patch antenna 9B, the feeder circuit 5 is formed with an impedance transformer 7 for connection to the patch antenna part 3B at the high impedance end. The feeder circuit 5 which is connected to the impedance transformer 7 matches the input impedance to 50Ω. The length of the patch antenna part 3B in the polarization direction is a length of a whole multiple of about half of the guide wavelength λg, while the length of the impedance transformer 7 is a whole multiple of about one-quarter of the guide wavelength λg.

However, if providing slits at the patch antenna part 3A as shown in FIG. 1B for impedance matching between the patch antenna part and the feeder circuit, the antenna shape becomes complicated and etching of the patch antenna part 3A becomes difficult. Further, as shown in FIG. 1C, if connecting an impedance transformer 7 of a high impedance to the patch antenna part 3B, the width of the line of the impedance transformer 7 becomes extremely fine. In the case of use for 76.5 GHz transmission/reception, the width of the line becomes about 20 μm or so. The line width ends up becoming narrower than even the minimum line width of 100 μm of the processing limit.

Further, when using a microstrip patch antenna for high frequency transmission/reception, the wavelength of the operating frequency is short, so a little dimensional error has a large effect on the performance. That is, the conventional structure microstrip patch antennas 9A and 9B shown in FIG. 1B and FIG. 1C have many end faces and are complicated in structures, so there was the problem of large deterioration of performance due to manufacturing error at the time of pattern formation by etching etc.

The present invention attempts to solve the problems underlying the conventional antenna. Aspects of the present invention will be described below in detail based on the specific embodiments thereof. In descriptions of embodiments of the present invention, for a better understanding, the same reference numerals will be assigned to components identical to those of the conventional micropatch antenna described in conjunction with FIG. 1A to FIG. 10.

Below, the attached drawings will be used to explain embodiments of the present invention in detail based on specific examples. Note that, the present invention can be applied to both microstrip patch antennas and slot antennas, but first a first aspect to which the present invention can be applied, a microstrip patch antenna, will be explained, then a second aspect to which the present invention can be applied, that is, a slot antenna, will be explained. Here, components the same as the conventional microstrip patch antennas 9A and 9B explained from FIG. 1A to FIG. 1C will be explained assigned the same references.

Note that the microstrip patch antenna of the first aspect is comprised of a dielectric substrate on the bottom surface of which a conductive ground plate is formed and on the top surface of which a patch antenna part and a feeder circuit formed by a conductor are provided. The slot antenna of the second aspect is provided with a slot antenna part provided by a rectangular opening of a ground plate and a feeder circuit formed by a slit shaped opening connected to the same, but the two appear completely the same in configuration when viewed by a plan view. Accordingly, in the embodiments of the present invention, the configuration of the microstrip patch antenna will be explained in detail, then, to avoid overlap of explanation, the configuration of the slot antenna will be explained focusing on only the basic parts and the points of difference.

Figure 2A:
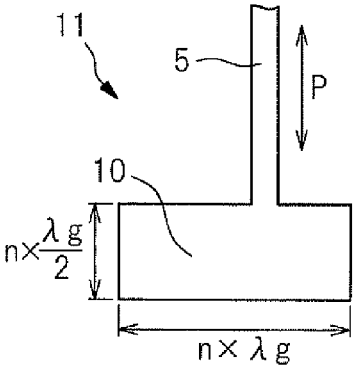
FIG. 2A is a plan view showing the shape of the patch antenna part of a microstrip patch antenna of a first embodiment of the present invention.
Figure 2B:
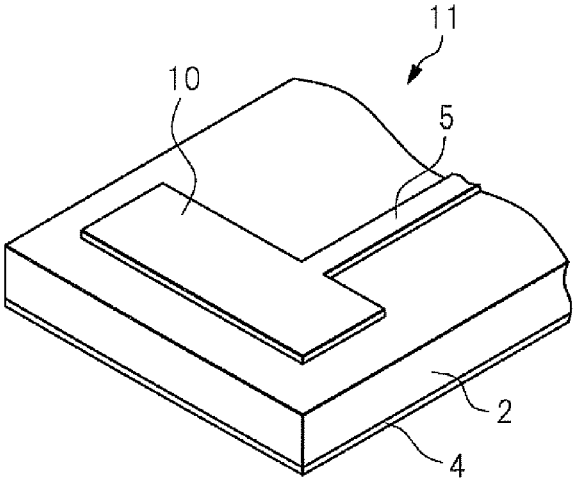
FIG. 2B is a perspective view showing the overall configuration of the microstrip patch antenna of the first embodiment of the present invention.

FIG. 2A and FIG. 2B show a microstrip patch antenna 11 of a first embodiment of the present invention. A patch antenna part 10 and a feeder circuit 5 are formed by copper foil on a dielectric substrate 2 on the bottom surface of which a ground plate 4 is laminated. The microstrip patch antenna 11 shown in FIG. 2B is, for example, comprised of a dielectric substrate 2 of a thickness of 0.124 mm and a dielectric constant of 2.2 on the two surfaces of which 18 μm copper foil is provided. The patterns of the patch antenna part 10 and the feeder circuit 5 may be formed by etching the copper foil.

The patch antenna part 10 is rectangular. The feeder circuit 5 is connected to one side of the patch antenna part 10, at a position offset from the center point of that side in either the left or right direction, in a state perpendicular to that side. The location for connection of the feeder circuit 5 to one side of the patch antenna part 10 is made the location for obtaining impedance matching of the patch antenna part 10 and the feeder circuit 5. For example, when the impedance of the feeder circuit 5 is 60Ω, the input impedance of the location of the patch antenna part 10 for connection to the feeder circuit 5 is made near 60Ω. This location on one side of the patch antenna part 10 for connection with the feeder circuit 5 will be explained in detail later, but is a position separated from the center point of the side by exactly a predetermined distance in either the left or right direction.

The length of the long sides of the rectangular patch antenna part 10 shown in FIG. 2A and FIG. 2B is a whole multiple of the guide wavelength λg by which the operating frequency of the wave which the microstrip patch antenna 11 receives is propagated, while the length of the short sides is a whole multiple of about half of the guide wavelength λg by which the operating frequency of the wave which the microstrip patch antenna 11 receives is propagated. Further, as shown by the arrow P in FIG. 2A, the short side direction of the patch antenna part 10 becomes the polarization direction of the wave which the microstrip patch antenna 11 receives. For example, in on-board radar, the length of the long sides of the patch antenna part 10 may be made the guide wavelength λg of the wave which the microstrip patch antenna 11 receives, while the length of the short sides may be made half of the guide wavelength λg.

Figure 2C:
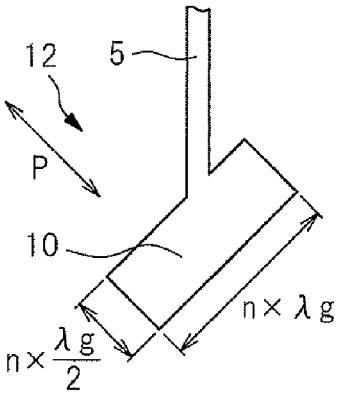
FIG. 2C is a plan view showing the shape of the patch antenna part of a microstrip patch antenna of a second embodiment of the present invention.
Figure 2D:
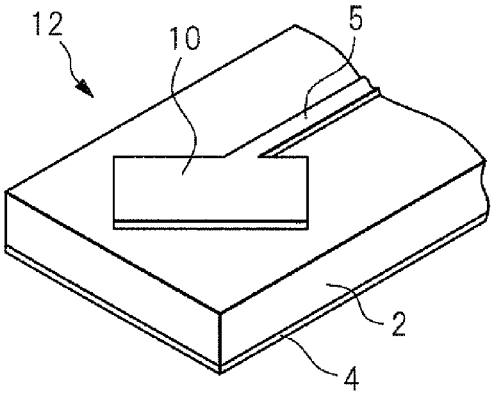
FIG. 2D is a perspective view showing the overall configuration of the microstrip patch antenna of the second embodiment of the present invention.

FIG. 2C and FIG. 2D show a microstrip patch antenna 12 of a second embodiment of the present invention. A patch antenna part 10 and a feeder circuit 5 are formed on a dielectric substrate 2, provided with dimensions similar to the microstrip patch antenna 11 of the first embodiment, by etching copper foil. The dimensions of the patch antenna part 10 of the second embodiment may be the same as the dimensions of the patch antenna part 10 of the microstrip patch antenna 11 of the first embodiment. The position of the patch antenna part 10 for connection with the feeder circuit 5 may be the same as the microstrip patch antenna 11 of the first embodiment. That is, in the first embodiment, the feeder circuit 5 was connected perpendicular to the patch antenna part 10, but in the second embodiment, the feeder circuit 5 is connected to the patch antenna part 10 in a state inclined by 45 degrees to the offset side.

Therefore, the patch antenna part 10 of the second embodiment receives a wave having a polarization plane with a polarization direction, shown by the arrow P in FIG. 2C, inclined by 45 degrees from the top left to the bottom right of FIG. 2C (linear polarized wave in direction of 45 degree incline with respect to ground surface). The reason for making the polarization direction incline by 45 degrees in this way is to, with on-board radar, avoid interference between the wave emitted from an on-coming vehicle mounting radar and the wave emitted from one's own vehicle. That is, if making the polarization direction of the wave emitted from one's own vehicle incline from the top left to the bottom right of FIG. 2C by 45 degrees, the polarization direction of the wave emitted from the on-coming vehicle will be in a direction inclined by 45 degrees from the top right to the bottom left of FIG. 2C and will perpendicularly intersect the wave emitted from one's own vehicle, so interference can be avoided.

Here, the position where the feeder circuit 5 is connected to the patch antenna part 10 will be explained. FIG. 3B shows a microstrip patch antenna 12 of a second embodiment. The polarization direction shown by the arrow P is a direction perpendicularly intersecting the long sides of the patch antenna part 10. The direction perpendicular to this polarization direction is shown by the arrow R. This is defined as the "resonance direction". Here, the location of the long side of the patch antenna part 10 to which the feeder circuit 5 is connected is defined as A, the location of the long side at the opposite side is defined as C, and the location of the resonance direction at the center point of the location A and the location B is defined as B. Further, the length of the long sides of the patch antenna part 10 is defined as λg and the length of the short sides is defined as half of λg.

Figure 3A:
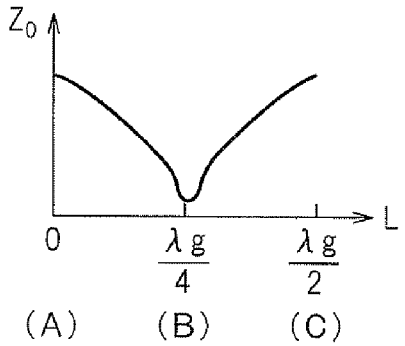
FIG. 3A is a graph showing the changes in impedance in a direction perpendicular to a side of a patch antenna part to which a feeder circuit is connected of the first embodiment at the end part of that side.
Figure 3B:
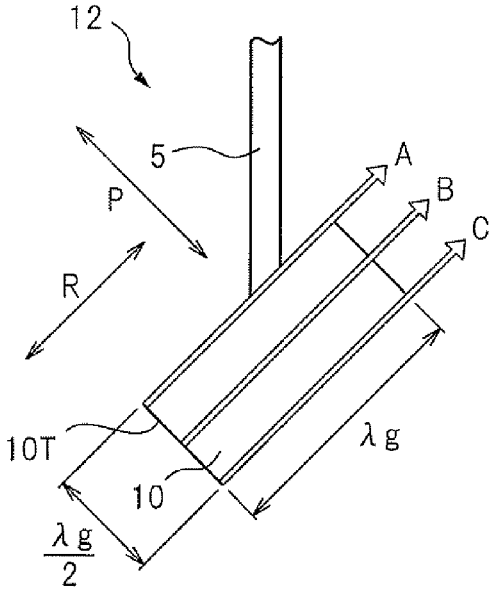
FIG. 3B is a view showing locations of three parts for measurement of impedance in a direction parallel to a side of a patch antenna part to which a feeder circuit is connected of the first embodiment.

FIG. 3A shows the impedance $Z_0$ with respect to a distance L of the polarization direction P at the end 10T of the patch antenna part 10 shown in FIG. 3B. The impedance $Z_0$ of the polarization direction P at the end 10T of the patch antenna part 10 becomes large at the location A and the location C and is smallest at the location B. The impedance $Z_0$ of the polarization direction P of the patch antenna part 10 exhibits a similar trend anywhere in the resonance direction R. The impedance $Z_0$ at the location B is the smallest.

Figure 3C:
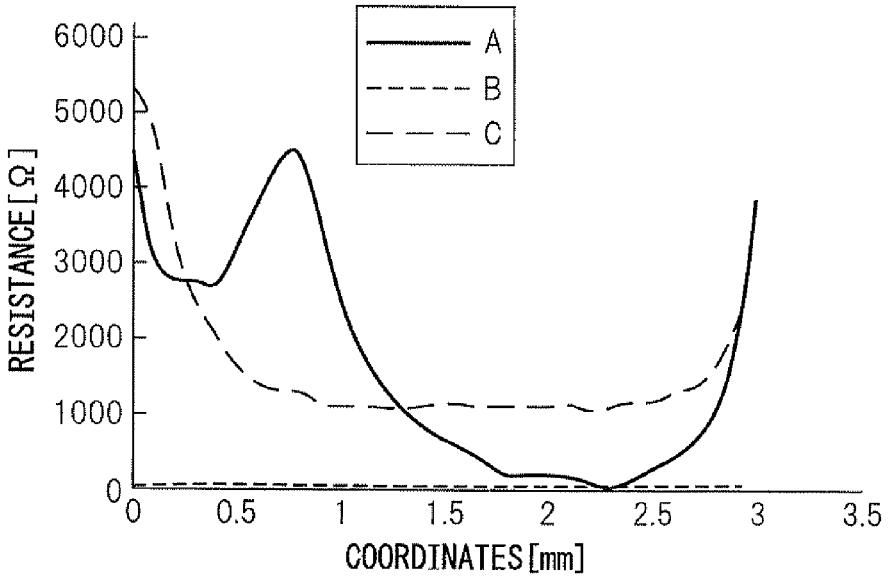
FIG. 3C is a graph showing changes in the input impedance at the locations shown in FIG. 3B.

Further, at the locations A, B, and C shown in FIG. 3B, if measuring the resistance values in accordance with the distance (coordinates) from the end 10T, the change in the resistance value (input impedance) in accordance with the coordinates from the end face becomes as shown in FIG. 3C. From this figure, at the location B, the input impedance is the lowest regardless of the coordinates, while at the location C, except at the two ends, the value of the input impedance does not change from a predetermined value due to the coordinates. As opposed to this, the input impedance at the location A changes greatly in accordance with the coordinates. This is because the impedance at the feeder part end face of the patch antenna part 10 changes depending on the position due to the occurrence of a higher order mode.

As will be understood from FIG. 3C, if connecting the feeder circuit 5 to the end 10T of the patch antenna part 10 at the location A, the input impedance will be high, while if connecting it to the coordinate 2.3 side of the location A of the patch antenna part 10, the input impedance is the lowest. Further, if connecting the feeder circuit 5 to the location of the high impedance of the patch antenna part 10, the amount of reflection of the traveling wave, input from the feeder circuit 5 to the patch antenna part 10, to the feeder circuit 5 becomes greater and the radiation efficiency from the patch antenna part 10 falls. Accordingly, to reduce this amount of reflection, the feeder circuit 5 has to be provided at a position impedance matched with the patch antenna part 10.

Figure 4A:
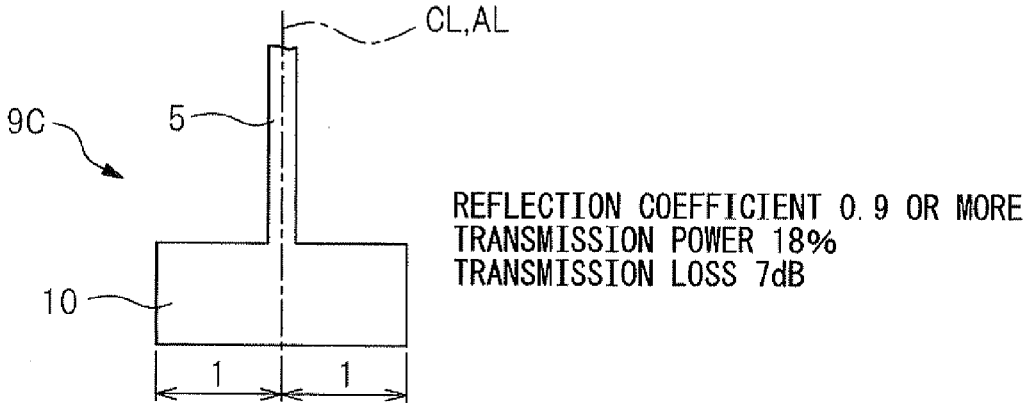
FIG.4A PRIOR ART
FIG. 4A is a view showing the state when connecting a patch antenna part of a first embodiment having a long side of the wavelength of the transmission/reception frequency and having a short side of half the wavelength of the transmission/reception frequency matched with the centerline of the feeder circuit at the center part of the feeder circuit side.

Here, impedance matching in the case of connecting the feeder circuit 5 to the patch antenna part 10 will be explained. FIG. 4A shows a conventional microstrip patch antenna 9C where the centerline AL of the feeder circuit 5 is aligned with the centerline CL passing through the center point of the length sides of the patch antenna part 10 for connection. The feeder circuit 5 is perpendicularly connected to the patch antenna part 10. The microstrip patch antenna 9C in this state is assumed to have a reflection coefficient of 0.9 or more, a transmission power of 18%, and a transmission loss of 7 dB. Further, the position of the centerline CL is defined as "0" and the lengths from the centerline CL to the two ends of the patch antenna part 10 are defined as "1". However, if the length of the long sides of the patch antenna part 10 is, for example, made the transmission/reception frequency λg, the length "1" is half of λg.

Figure 4B:
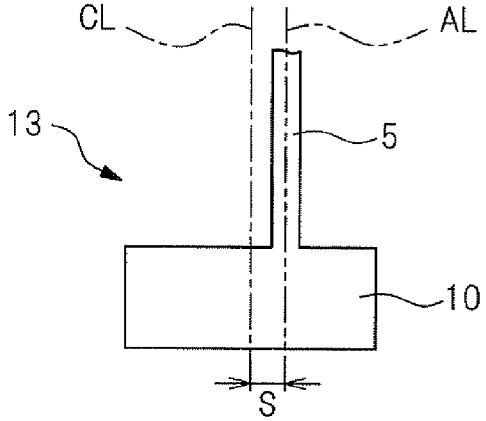
FIG. 4B is a view showing the state where a part of the feeder circuit connecting to the patch antenna part is offset to one end side by exactly a predetermined distance from the position shown in FIG. 4A.
Figure 4C:
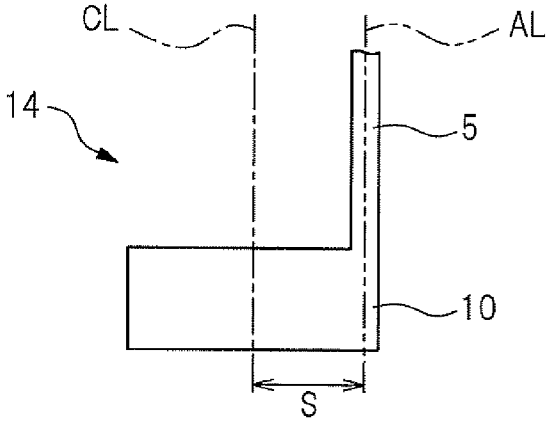
FIG. 4C is a view showing the state where a part of the feeder circuit connecting to the patch antenna part is made one end of the patch antenna part.
Figures 5A, 5B:
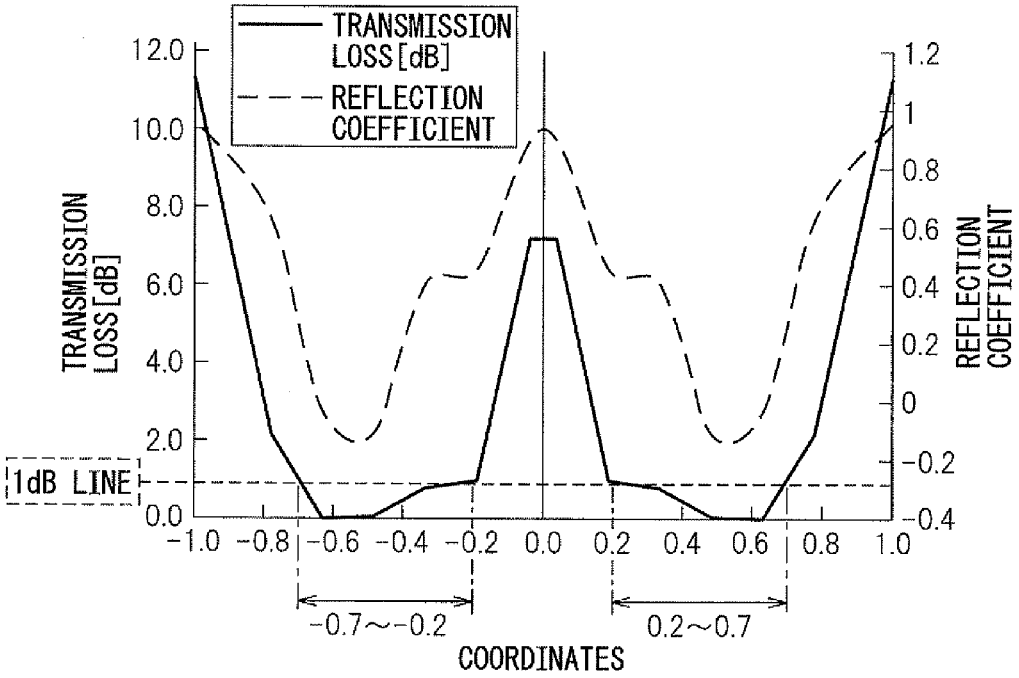
FIG. 5A is a map showing changes in characteristics of the patch antenna part which gradually offsetting the location of connection of the feeder circuit to the patch antenna part from the position shown in FIG. 4A to the position shown in FIG. 4C and to the end position at the opposite side.
FIG. 5B is a graph showing continuous changes in the transmission loss and reflection coefficient in the map shown in FIG. 5A.

From the state of FIG. 4A, as shown in FIG. 4B, the position of the centerline AL of the feeder circuit 5 which is connected to the patch antenna part 10 is gradually shifted from the centerline CL passing through the center point of the long sides of the patch antenna part 10 and offset in "0.01" units with respect to "1" up to the end position shown in FIG. 4C. FIG. 5A shows the change in characteristics of the patch antenna part 10 to representative offset values S when gradually offsetting the centerline AL of the feeder circuit 5 which is connected to the patch antenna part 10 to the left and right from the centerline CL of the patch antenna part 10. The negative values shown in FIG. 5A are values in the case of offset of the feeder circuit 5 to the left from the centerline CL of the patch antenna part 10, while the positive values are values in the case of offset of the feeder circuit 5 to the right from the centerline CL of the patch antenna part 10.

FIG. 5A shows with resistance of the patch antenna part 10, reflection coefficient, transmission power, and transmission loss with respect to representative offset values S. However, these are simulation values in the case of making the resistance of the feeder circuit 5 which is connected to the patch antenna part 10 60Ω and making the wavelength λg 2.86 mm. Further, FIG. 5B shows the changes in the transmission loss (solid line) and reflection coefficient (broken line) of the patch antenna part 10 in the case of continuously changing the offset value S of the centerline AL of the feeder circuit 5 with respect to the patch antenna part 10. As explained above, if defining the length of the long sides of the patch antenna part 10 as the wavelength λg of the transmission/reception frequency, the length "1" corresponds to half of the wavelength λg. That is, the characteristics shown in FIG. 5B are similar even if the transmission/reception frequency changes. The length "1" corresponds to one-half of the wavelength λg of the transmission/reception frequency.

As will be understood from the characteristics shown in FIG. 5B, when keeping the transmission loss of the patch antenna part 10 down to 1 dB or less in the case of changing the offset value S of the centerline AL of the feeder circuit 5 with respect to the patch antenna part 10, it is learned that it is sufficient to make the offset value S of the centerline AL of the feeder circuit 5 with respect to the patch antenna part 10 a range of 0.2 to 0.7 to the left or right of the centerline AL of the patch antenna part 10 and that the optimum value is around 0.5. The offset value S of the feeder circuit 5 suitable for the microstrip patch antenna of the present invention is the same both in the first embodiment and the second embodiment shown in FIG. 2A to FIG. 2D. From this, the offset value S of the feeder circuit 5 suitable for the microstrip patch antenna of the present invention should be determined so as to make the transmission loss of the patch antenna part 10 a predetermined value or less.

From the above, it is learned that when optimizing the transmission loss of the patch antenna part 10 in the case of changing the offset value S of the centerline AL of the feeder circuit 5 with respect to the patch antenna part 10, it is sufficient to make the offset value S of the centerline AL of the feeder circuit 5 with respect to the patch antenna part 10 a position of one-quarter of the wavelength λg of the frequency by which the patch antenna part 10 transmits and receives waves.

Figure 6A:
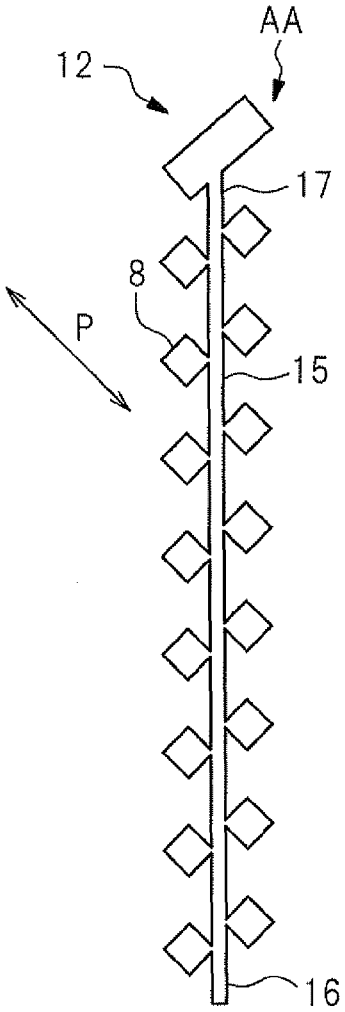
FIG. 6A is a plan view showing the basic configuration of a microstrip array antenna providing a microstrip patch antenna of the second embodiment of the present invention at the terminal end of a feeder strip line.
Figure 6B:
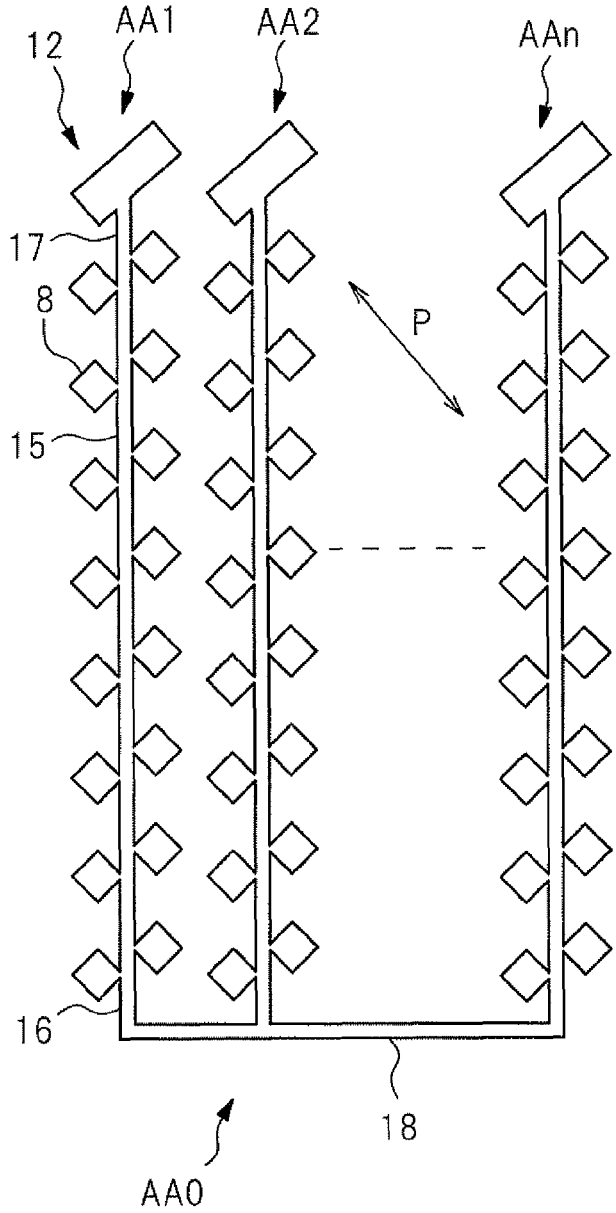
FIG. 6B is a plan view showing an antenna of a configuration of a plurality of microstrip array antennas shown in FIG. 6A arranged in parallel.

FIG. 6A shows the basic configuration of a microstrip array antenna AA provided with a microstrip patch antenna 12 of the second embodiment of the present invention at an end 17 of a feeder strip line 15. Further, FIG. 6B shows a microstrip array antenna AA0 comprised of a plurality of microstrip array antennas AA of the basic configuration shown in FIG. 6A arranged in parallel and connected at their input ends 16 by a connecting circuit 18. At the two sides of the feeder strip lines 15 connected to the microstrip patch antennas 12 of the second embodiment of present invention, pluralities of rectangular microstrip antenna elements 8 are attached for feed of power from the corners. The mounting intervals of the microstrip antenna elements 8 at one side of each feeder strip line 15 are for example intervals of the guide wavelength λd.

In the microstrip array antennas AA or microstrip array antennas AA0 configured as shown in FIG. 6A or FIG. 6B, it is possible to transmit/receive a wave arriving from a direction perpendicular to the paper surface of the drawing. Further, the polarization plane of the wave which the microstrip array antenna AA or microstrip array antenna AA0 transmits/receives is inclined by the 45 degrees of the polarization plane shown in FIG. 6A and FIG. 6B. Further, by connecting the microstrip patch antenna 12 of the second embodiment to the terminal end 17 of the feeder strip line 15, the polarization direction of the microstrip patch antenna 12 matches the polarization direction of the microstrip array antenna AA or microstrip array antenna AA0 and the residual power reaching the terminal end of the feeder strip line 15 can be effectively radiated compared with a conventional antennas.

Accordingly, in the past, the feeder line had to be bent or else the polarization direction could not be inclined, while in the microstrip array antenna AA or AA0 of the present embodiment, it is possible to make the polarization direction match, without bending the feeder circuit, by just using the microstrip patch antenna 12 of the second embodiment. Due to the above, by adopting the configurations of FIG. 6A and FIG. 6B when designing antennas, it is possible to produce good efficiency antennas with inclined polarization directions.

Figure 7:
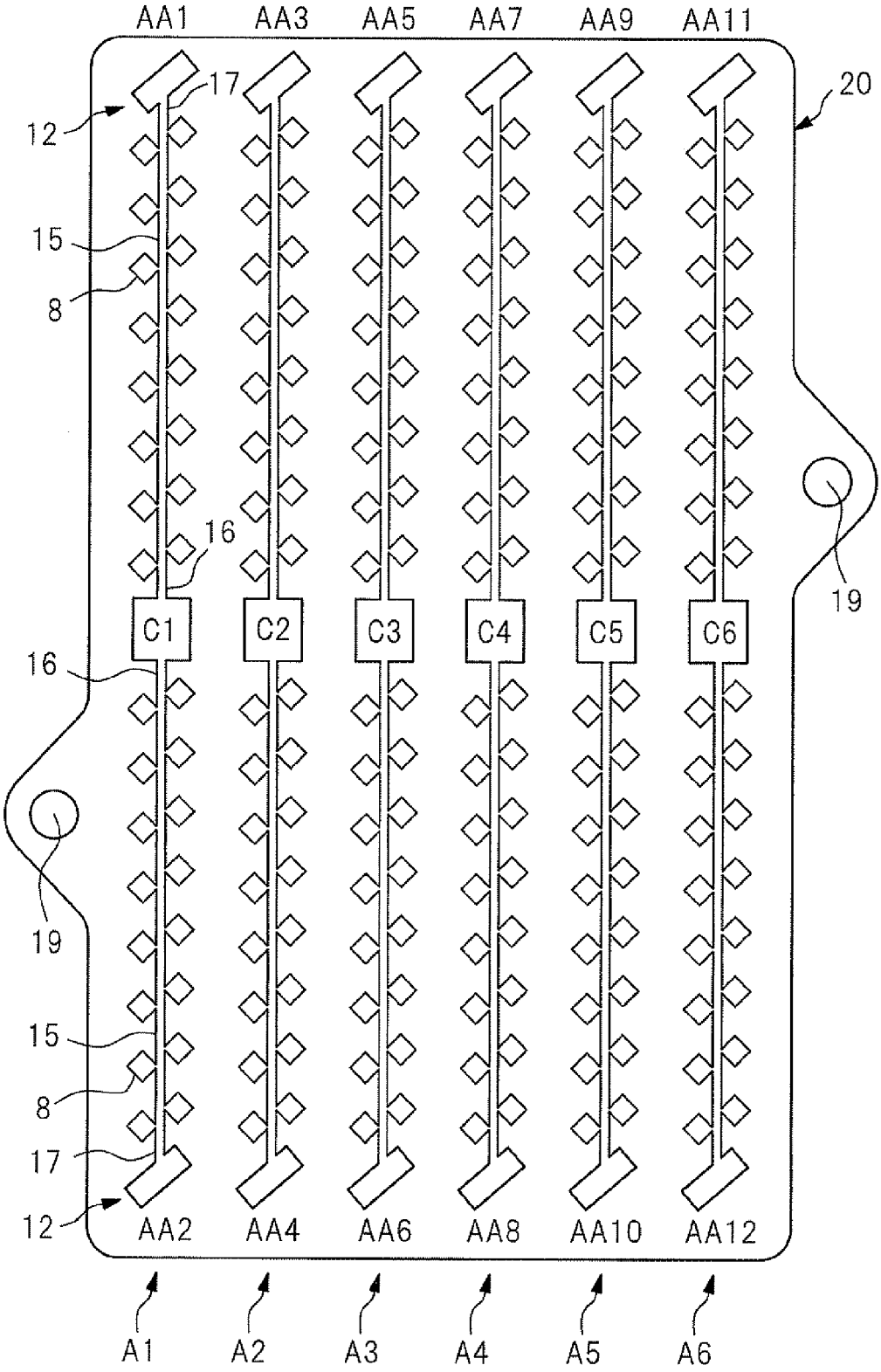
FIG. 7 is a plan view showing the configuration of an embodiment of an antenna of radar configured using the microstrip patch array antenna shown in FIG. 6A.

FIG. 7 shows the configuration of a specific embodiment of a transmission/reception antenna 20 for radar comprised using a plurality of the microstrip patch antennas AA shown in FIG. 6A. In this embodiment, at the respective upward and downward directions of the feeder terminals C1 to C6, input ends 16 of two microstrip patch antennas AA are connected. The microstrip line 15 is arranged in a straight line. The illustrated transmission/reception antenna 20 for radar can receive waves with polarization planes inclined by 45 degrees with respect to the microstrip line 15 which arrive from a direction perpendicular to the paper surface.

In the specific example shown in FIG. 7, the feeder terminal C1 has two microstrip patch antennas AA1 and AA2 connected point symmetrically whereby the antenna A1 is configured. Subsequently, similarly, the feeder terminals C2 to C6 have two microstrip patch antennas AA3 and AA4, AA5 and AA6, AA7 and AA8, AA9 and AA10, and AA11 and AA12 connected to them whereby the antennas A2 to A6 are configured. Accordingly, the transmission/reception antenna 20 is provided with six antennas A1 to A6. Further, at the two ends of the transmission/reception antenna 20, mounting holes 19 for mounting to the radar are provided. Note that, one feeder terminal may also have further set of microstrip patch antennas additionally connected to it.

Figure 8:
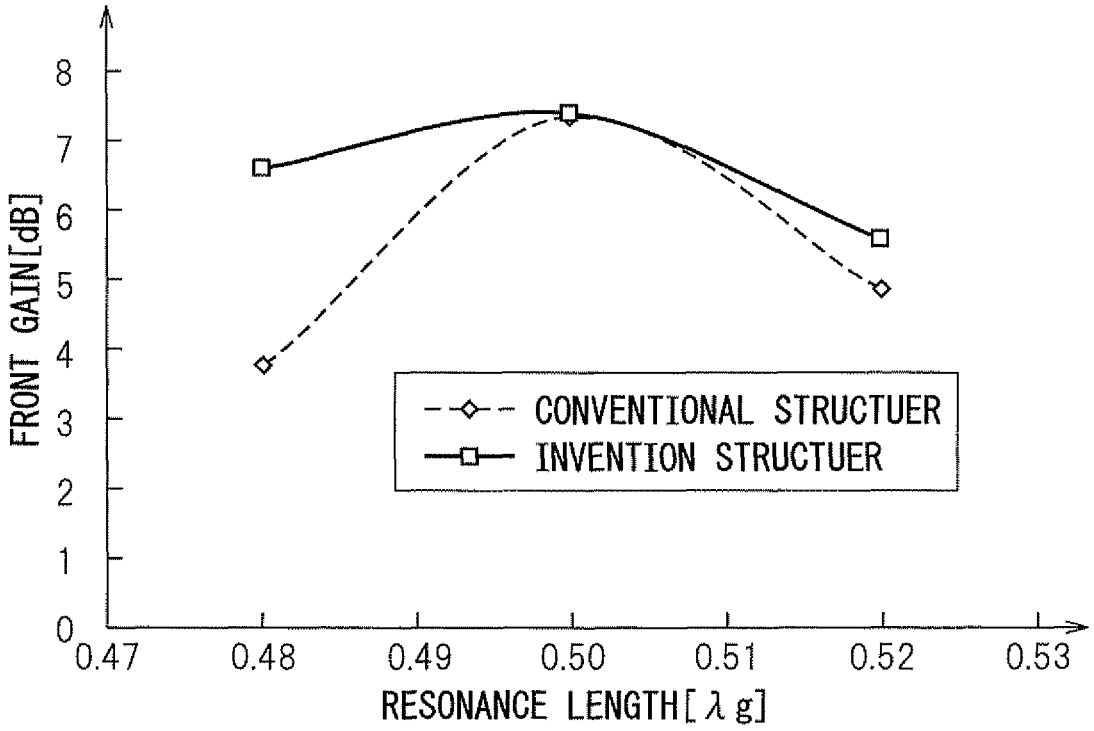
FIG. 8 is a graph showing by comparison the changes in a front gain in the case where the resonance lengths of the patch antenna part of a conventional structure and the patch antenna part of the structure of the present invention change due to manufacturing error.

FIG. 8 shows the results of confirmation by simulation of the changes of the front gain obtained by receiving an incoming wave from a front direction of the antenna when the resonance lengths of microstrip patch antennas of the conventional structure and the structure of the present invention change due to manufacturing error. Here, the change in the front gain of the antenna of the conventional structure is shown by the broken line, while the change in the front gain of the antenna of the structure of the present invention is shown by the solid line. In the conventional structure, when the resonance length changed by the 0.48 λg to 0.52 λg due to manufacturing error, the drop in the gain was −3.5 dB. As opposed to this, with the structure of the present invention, in the antennas of both the first and second embodiments, when changing the resonance length by exactly the 0.48 λg to 0.52 λg corresponding to manufacturing error, the drop in the gain was only −1.8 dB. From the above, it could be confirmed that the microstrip patch antenna of the structure of the present invention, compared with the microstrip patch antenna of the conventional structure, had less end faces, was simpler in structure, had less deterioration of performance due to manufacturing error at the time of pattern formation by etching etc., and was strong against manufacturing error.

Furthermore, the structure of present invention enables a reduction of the number of end faces (number of sides) and number of corners R in the antenna patterns. For example, the numbers of end faces of the microstrip patch antennas 10A and 10B of the conventional structures shown in FIG. 1B and FIG. 1C are "11" and the numbers of corners R are "10", while the numbers of end faces of the microstrip patch antennas 11 and 12 shown in FIG. 2A and FIG. 2C of the present invention are "7" and the numbers of corners R are "6". The numbers of end faces are reduced by 36% and the numbers of corners R by 40%. The deterioration in performance due to manufacturing error at the time of pattern formation by etching etc. therefore can be made smaller. As a result, in the microstrip patch antenna of the present invention, the number of end faces of the patch antenna part is reduced and the number of perpendicular corners is reduced to thereby simplify the structure of the patch antenna part and reduce dimensional error, so there is little degradation of performance in the case of use of the microstrip patch antenna for high frequency transmission/reception.

Figure 9A:
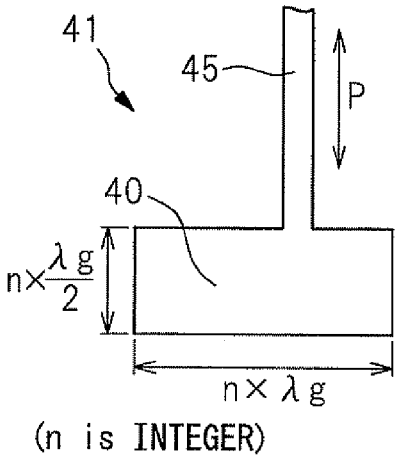
FIG. 9A is a plan view showing the shape of the slot antenna part of a slot antenna of a third embodiment of the present invention.
Figure 9B:
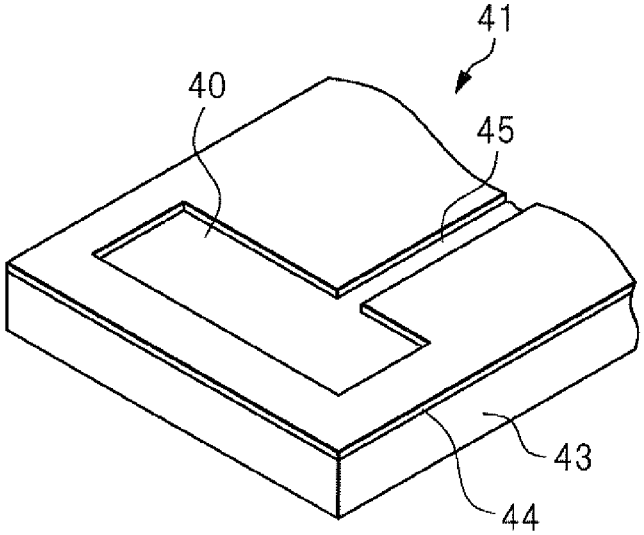
FIG. 9B is a perspective view showing the overall configuration of a slot antenna of the third embodiment of the present invention.

Next, a slot antenna of the second aspect to which the present invention can be applied will be explained. FIG. 9A and FIG. 9B show a slot antenna 41 of a third embodiment of the present invention. The slot antenna part 40 and the feeder circuit 45 are formed by slit-shaped openings on a metal ground plate 44 set on the dielectric substrate 43. The slot antenna 41 of the third embodiment of the present invention shown in FIG. 9B can be configured by, for example, a dielectric substrate 43 of a thickness of 0.124 mm and a dielectric constant of 2.2 on the top surface of which an 18 μm ground plate 44 is set. Note that, there are also cases where there is no dielectric substrate 43. Further, the dielectric substrate 43 may also be set on the ground plate 44.

The slot antenna part 40 is rectangular. The feeder circuit 45 is connected to one side of the slot antenna part 40 in a state perpendicular to that side at a position offset from the center point of that side to either the left or right direction. The location where the feeder circuit 45 is connected to the slot antenna part 40 is made a location giving impedance matching between the slot antenna part 40 and the feeder circuit 4. For example, when the impedance of the feeder circuit 45 is 60Ω, the input impedance of the location where the feeder circuit 45 is connected to the slot antenna part is made near 60Ω. The location on one side of the slot antenna part 40 connected to the feeder circuit 45 is, in the same way as the position of the above-mentioned patch antenna part 10 to which the feeder circuit 5 is connected, a position separated from the center point of that side in either the left or right direction by exactly a predetermined distance.

Figure 9C:
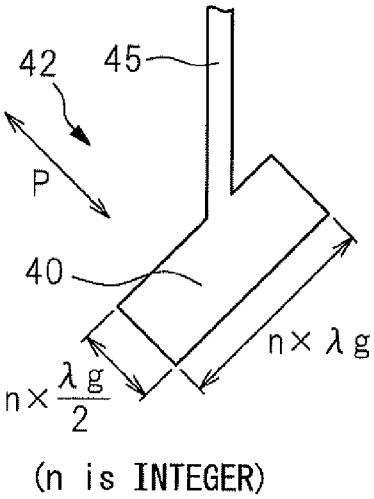
FIG. 9C is a plan view showing the shape of the slot antenna part of a slot antenna of a fourth embodiment of the present invention.
Figure 9D:
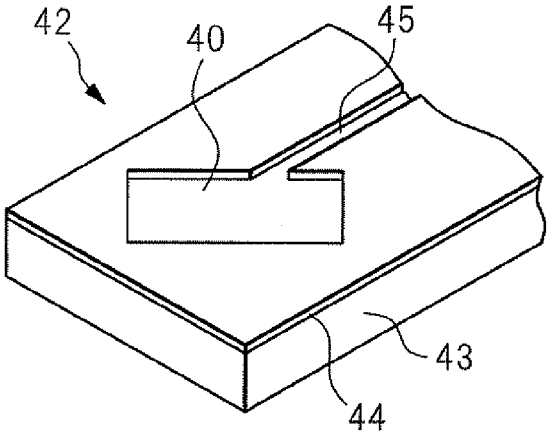
FIG. 9D is a perspective view showing the overall configuration of the slot antenna of the fourth embodiment of the present invention.

FIG. 9C and FIG. 9D show a slot antenna 42 of a fourth embodiment of the present invention. The slot antenna part 40 and the feeder circuit 45 are formed by slit-shaped openings at a metal ground plate 44 set on a dielectric substrate 4 provided with dimensions similar to the slot antenna 41 of the third embodiment. The dimensions of the slot antenna part of the fourth embodiment may be the same as the dimensions of the slot antenna 41 of the third embodiment. The position where which the feeder circuit 45 is connected to the slot antenna part 40 may be the same as the slot antenna 41 of the third embodiment. That is, in the third embodiment, the feeder circuit 45 is connected perpendicularly with respect to the slot antenna part 40, while in the fourth embodiment, the feeder circuit 45 is connected to the slot antenna part 40 in a state inclined by 45 degrees to the offset side.

Therefore, the slot antenna part 40 of the fourth embodiment receives a wave having a polarization plane with a polarization direction, shown by the arrow P, inclined by 45 degrees from the top left to the bottom right of FIG. 9C (linear polarized wave in direction of 45 degree incline with respect to ground surface). The reason for making the polarization direction incline by 45 degrees in this way is the same as with the microstrip patch antennas 11 and 12 in the first and second embodiment, that is, to avoid interference between the wave emitted from an on-coming vehicle mounting radar and the wave from one's own vehicle.

The slot antennas 41 and 42 of the third and fourth embodiments are configured with the patch antenna part 10 and the feeder circuit 5, which were formed by copper foil on the dielectric substrate 2 in the microstrip patch antennas 11 and 12 of the first and second embodiments, replaced with the slot antenna part 50 and feeder circuit 45 formed by the slit-shaped openings in the ground plate 44. Further, the matters explained regarding the above-mentioned microstrip patch antennas 11 and 12 using FIG. 3 to FIG. 8 all similarly apply to the slot antennas 41 and 42 and the slot array antennas configured using the slot antennas 41 and 42.

That is, the slot array antennas configured using the slot antennas 41 and 42 of the third and fourth embodiments may also be configured such as in FIG. 6A and FIG. 6B and configured such as in FIG. 7. The effects are also similar to the effects in the transmission/reception antenna 20 shown in FIG. 8. Accordingly, further explanations of the slot antennas 41 and 42 of the third and fourth embodiments and explanations of slot array antennas which can be configured using the slot antennas 41 and 42 will be omitted.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A transmission/reception antenna which is provided with:

a dielectric substrate on a bottom surface of which a conductive ground plate is formed; and a plurality of independent antennas formed by a conductor and arranged on a top surface of the dielectric substrate in parallel;

each of the plurality of antennas comprising:

a feeder terminal; and two microstrip antennas, each point symmetrically connected to the feeder terminal on opposite sides of the feeder terminal and each extending from the feeder terminal in a direction perpendicular to a direction on which feeder terminals of the plurality of antennas are arranged on the top surface of the dielectric substrate, wherein for each of the plurality of antennas the feeder terminal thereof is not connected to the feeder terminal of any other of the plurality of antennas on the dielectric substrate, and wherein each microstrip antenna comprises:

a rectangular shaped antenna part;

a feeder strip line provided with an input end and a terminal end, whose terminal end is connected inclined by 45 degrees to either the left or right to one side of the antenna part to which the feeder strip line is connected while offset to either end side by a predetermined distance; and a plurality of rectangular shaped microstrip patch antenna elements connected to at least one side of the feeder strip line, at their corners at predetermined intervals.

2. The transmission/reception antenna according to claim 1, wherein the predetermined distance is in a range of 0.2 to 0.7 units when distances to the two ends from a center of one side of the antenna part to which the feeder strip line is to be connected are "1" unit;

a length of the antenna part in a direction perpendicular to the polarization direction is a whole multiple of a guide wavelength by which an operating frequency of a wave received by the antenna is protected;

a length of the antenna part in a polarization direction is a whole multiple of half of the guide wavelength; and connecting intervals of the microstrip antenna elements at one side of each feeder strip line are the distance of the guide wavelength.

* * * * *